US011344059B2

(12) United States Patent
Han

(10) Patent No.: US 11,344,059 B2
(45) Date of Patent: May 31, 2022

(54) SMOKING DEVICE

(71) Applicant: Tyger Manufacturing LLC, San Mateo, CA (US)

(72) Inventor: Jeffrey Han, Los Altos Hills, CA (US)

(73) Assignee: Tyger Manufacturing LLC, San Mateo, CA (US)

( * ) Notice: Subject to any disclaimer, the term of this patent is extended or adjusted under 35 U.S.C. 154(b) by 158 days.

(21) Appl. No.: 16/687,487

(22) Filed: Nov. 18, 2019

(65) Prior Publication Data

US 2020/0085096 A1 Mar. 19, 2020

Related U.S. Application Data

(63) Continuation of application No. 16/436,633, filed on Jun. 10, 2019, now Pat. No. 10,477,890, which is a (Continued)

(51) Int. Cl.

| | |
|---|---|
| ***A24F 1/28*** | (2006.01) |
| ***A24F 1/32*** | (2006.01) |
| ***A24F 7/00*** | (2006.01) |

(52) U.S. Cl.

CPC ..... *A24F 1/28* (2013.01); *A24F 1/32* (2013.01); *A24F 7/00* (2013.01)

(58) Field of Classification Search

CPC ..... A24F 40/05; A24F 40/20; A24F 47/008; A24F 1/28; A24F 1/26; A24F 1/32;

(Continued)

(56) References Cited

U.S. PATENT DOCUMENTS 136,487 A * 3/1873 Buynitzky ..... A24F 1/00 131/180

1,136,487 A 3/1873 Buynitzky (Continued)

FOREIGN PATENT DOCUMENTS

CN 201869772 U 6/2011
CN 203841101 U 9/2014

(Continued)

OTHER PUBLICATIONS

USA, Component Force. "Silicone Rubber Caps." Silicone Rubber Caps, Caps Silicone, End Caps. Wayback Machine Generated, Sep. 20, 2012. Web. Apr. 14, 2017. (Year: 2017).*

(Continued)

*Primary Examiner* — Michael J Felton
*Assistant Examiner* — Katherine A Will
(74) *Attorney, Agent, or Firm* — Steven N. Fox, Esq.

(57) ABSTRACT

Disclosed is a smoking device for use by a person to consume a smoking material such as tobacco, medical marijuana, or the like. The smoking device comprises a glass housing having lower and upper open end portions and an inner portion. The smoking device further comprises a body having a rear body portion rotatably and sealably engaged with the lower open end portion of the glass housing. The smoking device further comprises an auger comprising a first end portion engaged with the rear body portion of the body and a second end portion extending within the glass housing to form a bowl area. Rotation of the body causes the auger to rotate and the smoking material to be moved upward thru the glass housing to the bowl area where it is ignited by a lighter or other heat source.

17 Claims, 5 Drawing Sheets

Related U.S. Application Data continuation of application No. 15/979,387, filed on May 14, 2018, now Pat. No. 10,314,333, which is a continuation of application No. 14/625,013, filed on Feb. 18, 2015, now Pat. No. 9,968,127.

(58) Field of Classification Search
CPC .... A24F 7/00; A24F 7/02; A24F 13/10; A24F 13/16; A24F 13/20
See application file for complete search history.

(56) References Cited

U.S. PATENT DOCUMENTS

| | | | | |
|---|---|---|---|---|
| 2,402,914 | A * | 6/1946 | Robertson | 131/180 |
| 2,533,956 | A | 12/1950 | Robertson | |
| 4,171,000 | A | 10/1979 | Uhle | |
| 4,286,416 | A | 9/1981 | Cooper, Jr. | |
| D267,886 | S | 2/1983 | Albertini | |
| 5,687,746 | A | 11/1997 | Rose | |
| 6,073,633 | A | 6/2000 | Herman | |
| 6,148,826 | A | 11/2000 | Lancaster | |
| 6,196,232 | B1 | 3/2001 | Chkadua | |
| 6,260,554 | B1 | 7/2001 | Rowland | |
| D687,181 | S | 7/2013 | Goch | |
| D709,751 | S | 7/2014 | Wu | |
| 8,925,714 | B1 | 1/2015 | Buser | |
| 8,967,153 | B2 | 3/2015 | Hoang | |
| D739,979 | S | 9/2015 | Smith | |
| 2005/0016553 | A1 | 1/2005 | Iannuzzi | |
| 2007/0267032 | A1* | 11/2007 | Shan | A24F 47/002 131/275 |
| 2010/0078035 | A1 | 4/2010 | Erickson | |
| 2011/0094524 | A1 | 4/2011 | Glover | |
| 2013/0269716 | A1 | 10/2013 | Hoang | |
| 2015/0013704 | A1* | 1/2015 | Maglione | A24F 1/30 131/330 |
| 2015/0020822 | A1 | 1/2015 | Janardhan | |
| 2015/0122277 | A1 | 5/2015 | Frobisher | |
| 2015/0136124 | A1 | 5/2015 | Aronie | |
| 2015/0144146 | A1 | 5/2015 | Selby | |
| 2015/0223523 | A1 | 8/2015 | McCullough | |
| 2016/0198769 | A1* | 7/2016 | Liu | F22B 1/284 131/329 |
| 2017/0035105 | A1 | 2/2017 | Jordan | |

FOREIGN PATENT DOCUMENTS

| | | |
|---|---|---|
| GB | 24730 | 10/1925 |
| GB | 715507 | 9/1954 |

OTHER PUBLICATIONS

Four Hitter. "Introducing the FourHitter." Wayback Machine Generated NPL. Dec. 2013. Web. <www.fourhitter.com> (Year: 2017).*

Craft Stylish, "Glass Blunt." LightEnergyGlass Blog Posting. Wayback Machine Generated NPL. Jun. 6, 2011. Web. <http://www.craftstylish.com/item/87092/glassblunt> (Year: 2011).*

Ravenstine, "Where can I find a very small auger?", date unknown, https://www.instructables.com/topics/Where-can-I-find-a-very-small-auger/, Instructables, US.

Dimadima, "Archimedes Screw Pump", date unknown, http://dimdima.com/science/science_common/show_science.asp?q_aid=268&q_title=Archimedes+Screw+Pump, DIMADIMA, Country of Publication Unknown.

grasscompany.com, "The BudBomb", Nov. 6, 2008, https://www.youtube.com/watch?v=hAq9eVEUGcl, grasscompany.com, Country of Publication Unknown.

craftstylish.com, "Glass Blunt", Jun. 11, 2011, https://www.craftstylish.com/item/87092/glass-blunt, craftstylish.com, Country of Publication Unknown.

pkmachinery.com, "Right and Left Hand Screws", date unknown, https://www.pkmachinery.com/faq/right-and-left-hand-screws.html, pkmachinery.com, China.

* cited by examiner

SMOKING DEVICE

CROSS-REFERENCE TO RELATED APPLICATIONS

This application claims the benefit of and priority to U.S. Utility patent application Ser. No. 16/436,633 filed on Jun. 10, 2019, now pending, which claims the benefit of and priority to U.S. Utility patent application Ser. No. 15/979,387 filed on May 14, 2018, now U.S. Pat. No. 10,314,333, which claims the benefit of and priority to U.S. Utility patent application Ser. No. 14/625,013 filed on Feb. 18, 2015, now U.S. Pat. No. 9,968,127, all of which are hereby incorporated into this specification by reference in their entirety.

BACKGROUND OF THE INVENTION

The present invention relates to smoking devices such as pipes used by a person to smoke or consume a smoking material such as tobacco, medical marijuana, or the like. Various conventional smoking devices have been designed. Such conventional devices are not designed for optimum performance, comfort, versatility, ease of use, portability, and fabrication.

SUMMARY OF THE INVENTION

The present invention is a smoking device that may be used by a person to consume or smoke a smoking material such as tobacco, medical marijuana, or the like. The smoking device comprises a glass housing having lower and upper open end portions and an inner portion. The smoking device further comprises a body having a rear body portion rotatably and sealably engaged with the lower open end portion of the glass housing by at least one sealing member. The body further comprises a plurality of air passage ways extending inward from a plurality of openings in the rear body portion. The smoking device further comprises an auger comprising a first end portion engaged with the rear body portion of the body and a second end portion extending within the inner portion of the glass housing to form a bowl area. Rotation of the body causes the auger to rotate and the smoking material to be moved upward thru the inner portion of the glass housing to the bowl area where it is ignited by a match, lighter or other heat source.

BRIEF DESCRIPTION OF THE DRAWINGS

The following description of the invention will be more fully understood with reference to the accompanying drawings in which.

DESCRIPTION OF THE INVENTION

Figure 1:
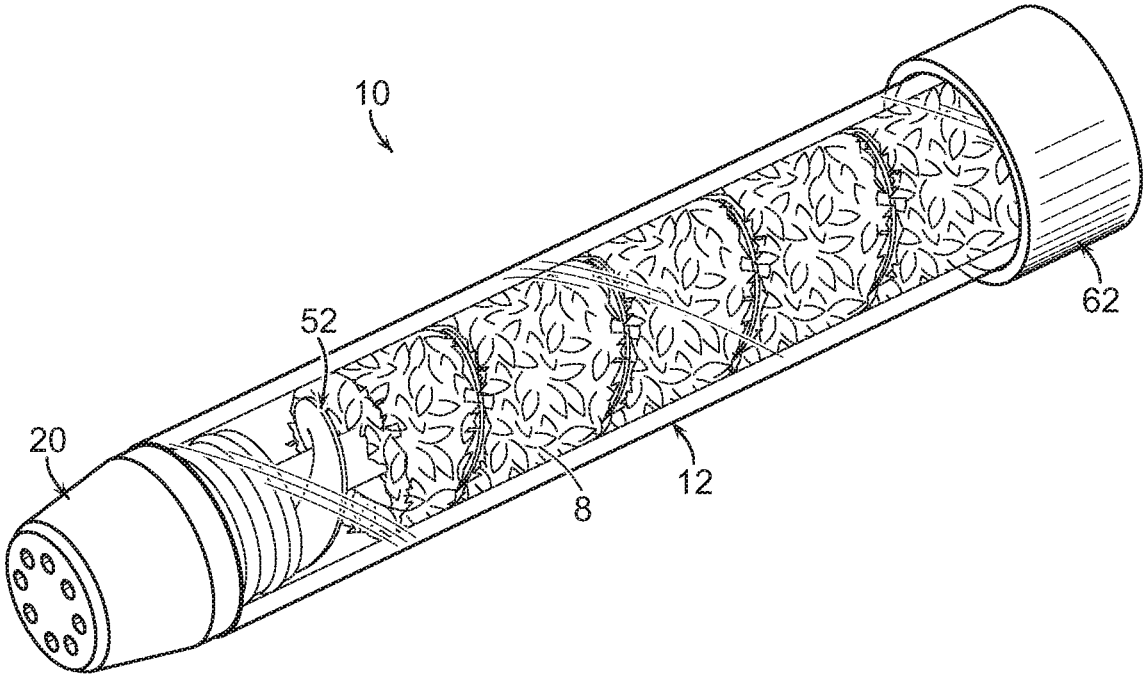
FIG. 1 is a front perspective view of a smoking device according the present invention.
Figures 2, 3:
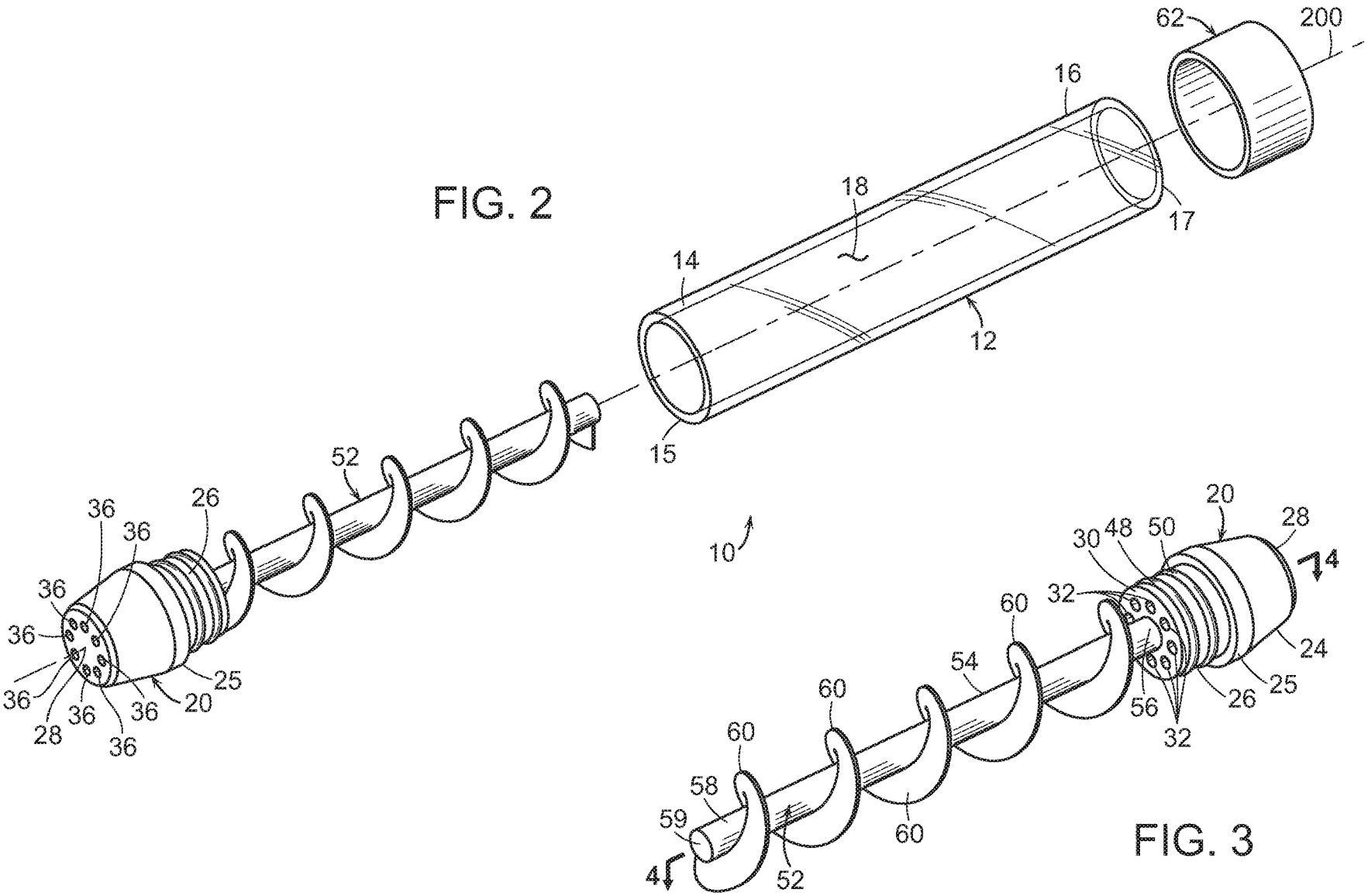
FIG. 2 is an exploded view of the smoking device.
FIG. 3 is rear perspective of a body and auger according to the present invention.
Figure 4:
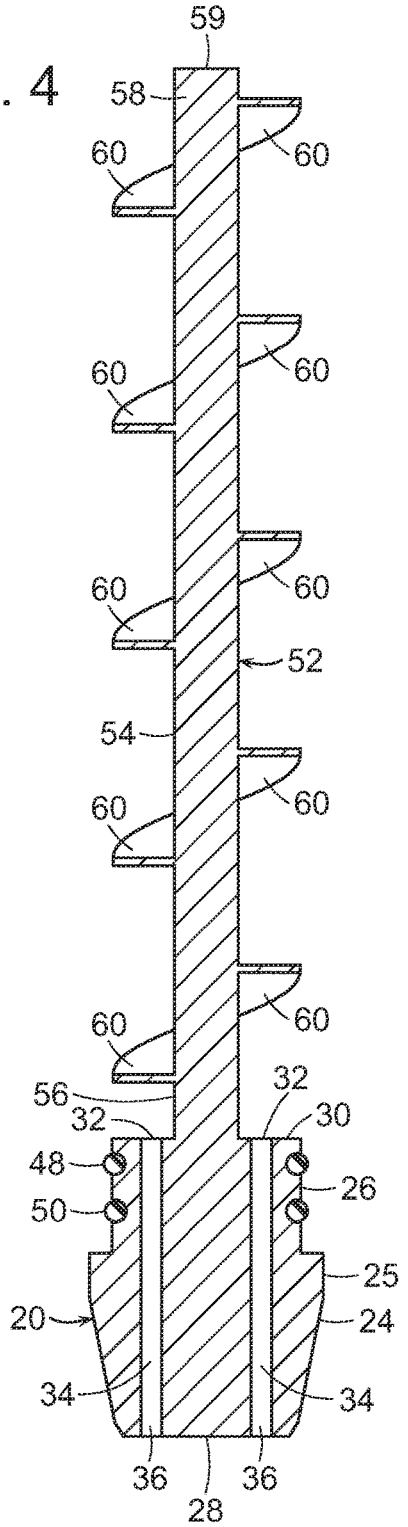
FIG. 4 is a cross-section view taken along line 3-3 of FIG. 3.

Referring to FIGS. 1 and 2, a smoking device 10 may be used by a person to smoke or consume a smoking material 8 such as tobacco, medical marijuana or the like. Smoking device 10 generally comprises a glass housing 12, a body 20 and an auger 52 engaged with or formed as part of body 20. As will be described more fully herein, rotation of body 20 causes auger 52 to rotate and smoking material 8 to move upward within housing 12 to a bowl area 100 (to be described) where it is ignited by a match, lighter or other heat source. Smoking device 10 provides an easier and more effective way of consuming smoking material 8 than conventional smoking devices.

Referring to FIG. 2, glass housing 12 comprises a lower open end portion 14, an upper open end portion 16, and an inner portion 18. Glass housing 12 is straight from lower open end portion 14 to upper open end portion 16. In the embodiment shown, glass housing 12 is a cylindrical tube having a length of about 86 mm, a wall thickness of about 2 mm, and an inside diameter of about 13 mm. Glass housing 12 is made from boro silicate glass or any other material having good heat resistant properties. Glass housing 12 is fabricated by conventional processes.

Referring to FIGS. 2 and 3, body 20 comprises a front body portion 24 that acts as a mouthpiece and having a front surface 28, an intermediate body portion 25, and a rear body portion 26 having a rear surface 30. Rear body portion 26 is rotatably disposed within lower open end portion 14 of glass housing 12. Intermediate body portion 25 of body 20 abuts lower open end portion 14 of glass housing 12. Rear body portion 26 has a diameter of about 13 mm but should be slightly less than the inside diameter of lower open end portion 14 to permit rotation therein. Body 20 further comprises a sealing member 48 engaged with and retained by an annular channel (not shown) formed in rear body portion 26 of body 20 to provide sealed engagement between rear body portion 26 of body 20 and lower open end portion 14 of housing 12 during rotation of rear body portion 26 relative to lower open end portion 14 of housing 12. In the embodiment shown, sealing member 48 is a rubber or-ring. Body 20 further comprises a sealing member 50 engaged with and retained by an annular channel (not shown) of rear body portion 26 to provide sealed engagement between rear body portion 26 of body 20 and lower open end portion 14 of housing 12. In the embodiment shown, sealing member 50 is a rubber or-ring. Sealing member 50 is provided in the event of failure of sealing member 48. The annular channels have a depth of about 1.78 mm. Sealing members 48 and 50 are made from silicone rubber having an outside diameter of about 13 mm, and a thickness of about 1 mm. Sealing members 48 and 50 are widely available as rubber o-rings. Different materials and hardness may be used so long as sealing members 48 and 50 allow and maintain rotatable sealed engagement between rear body portion 26 of body 20 and lower open end portion 14 of housing 12. Body 20 further comprises a plurality of openings 32 in rear surface 30 that lead to air passage ways 34 that terminate at openings 36 in front body portion 24 of body 20. Openings 32 and 36 are arranged in a circular pattern about front surface 28 and rear surface 30 of body 20. The plurality of openings 32 located on rear surface 30 of body 20 substantially or completely surround auger 52. More or less than eight (8) air passage ways 34 may be employed. Each of air passage ways 34 is shaped in the form of a cylinder having an inside diameter of about 1.5 mm Any diameter significantly larger results in smoking material passing thru the air passage ways. Any diameter significantly smaller reduces air flow. In the embodiment shown, front body portion 24, intermediate body portion 25, and rear body portion 26 are integrally made from a single piece of material such as brass. Body 20 may be made from any other heat resistant material such as steel and fabricated by conventional processes.

Figure 8:
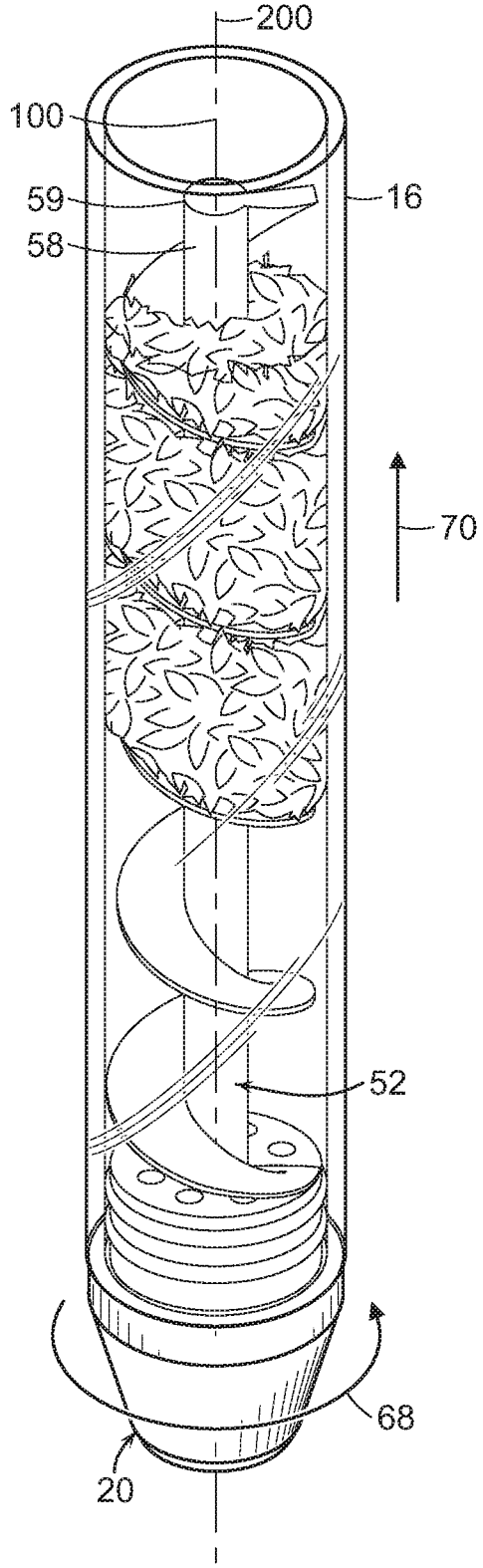
FIG. 8 is a perspective view of the smoking device after use and a number of clockwise rotations of the body and auger leaving a small amount of smoking material remaining.

With continued reference to FIG. 3, auger 52 comprises a first end portion 56 and a second end portion 58, and a spiral flange 60 extending from said first end 56 to said second end portion 58. Auger 52 further comprises a shaft 54 upon which the spiral flange is formed. Auger 52 has a length of about 73 mm Helical blade 60 has a diameter of about 13 mm and a pitch of about 17.3 mm. The diameter of helical blade 60 should be slightly less than the inside diameter of housing 12 to permit rotation therein. With reference to FIG. 8, when fully assembled, second end portion 58 of auger 52 is disposed about 6 mm inward from upper open end portion 16 of glass housing 12 leaving a cherry or burn area or bowl area 100 within and at said upper open end portion 16 of glass housing 12. Bowl area 100 is bound by upper open end portion 16 of glass housing 12 and a terminal end surface 59 of second end portion 58 of auger 52 adjacent to and facing bowl area 100. Auger 52, glass housing 12 extending from its lower open end portion 14 to upper open end portion 16, and bowl area 100 share a common central longitudinal axis 200. In the embodiment shown, shaft 54 of auger 52 is centered along central longitudinal axis 200. Rotation of body 20 causes rotation of auger 52 causing the smoking material within glass housing 12 to move toward to bowl area 100. Further rotation of body 20 causes auger 52 to expel the smoking material from upper open end portion 16 of glass housing 12. Auger 52 is press-fitted or otherwise engaged or secured to rear body portion 26 of body 20. Auger 52 is made from brass or any other heat resistant material such as steel and fabricated by conventional processes. Alternatively, body 20 and auger 52 may be made from a single piece of material.

Smoking device 10 further comprises a cap 62 (FIG. 2) removably engaged with upper open end portion 16 of glass housing 12. Cap 62 is made from plastic and fabricated by conventional processes. Cap 62 is provided so that glass housing 12 can be filled with smoking material 8 and to prevent loss of smoking material 8 during non use and/or transport of smoking device 10 thereby making smoking device 10 easily portable. Cap 62 may be made from a variety of materials such as silicone rubber and fabricated by conventional processes.

Figure 5:
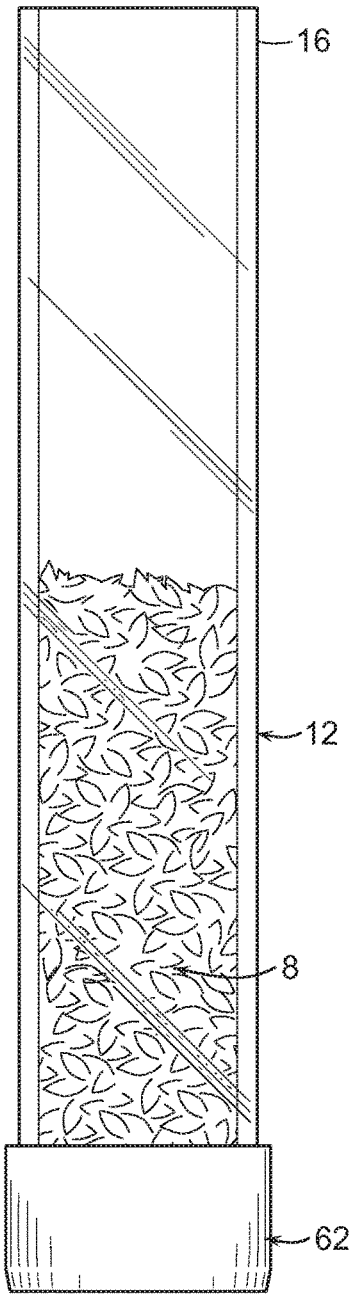
FIG. 5 is a view showing a housing of the smoking device filled with smoking material without insertion of the body and auger.
Figure 6:
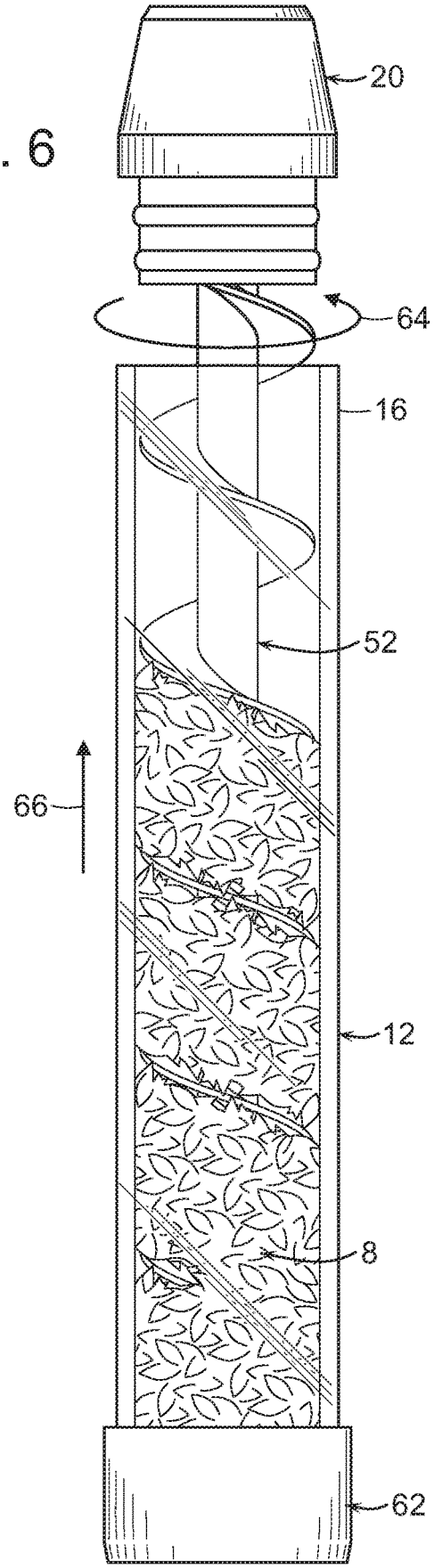
FIG. 6 is a view showing partial insertion of the body and auger within the housing by counter clockwise rotation of the body and auger causing movement of the smoking material around the helical blade of the auger.

Referring to FIGS. 5 and 6, where smoking device 10 is shown being filled with smoking material 8. As shown by FIG. 5, cap 62 is placed on upper open end portion 16 of glass housing 12. Housing 12 is flipped and disposed vertically so that cap 62 is resting upon a hard surface (not shown). Smoking material 8 is added thru lower open end portion 14 thereby filling upper open end portion 16 and inner portion 18. Housing 12 may be filled about half way with smoking material 8. As shown by FIG. 6, counter-clockwise rotation 64 of body 20 causes helical blade 60 of auger 52 to rotate and move smoking material 8 from upper open end portion 16 toward lower open end portion 14 of housing 12 as helical blade 54 moves inward to inner portion 18 of housing 12. Continued counter-clockwise rotation 64 of body 20 results in helical blade 60 being fully inserted within inner portion 18 of housing 12 with smoking material 8 surrounding most of helical blade 60 of auger 52. O-rings 48 and 50 provide sealed engagement.

Figure 7:
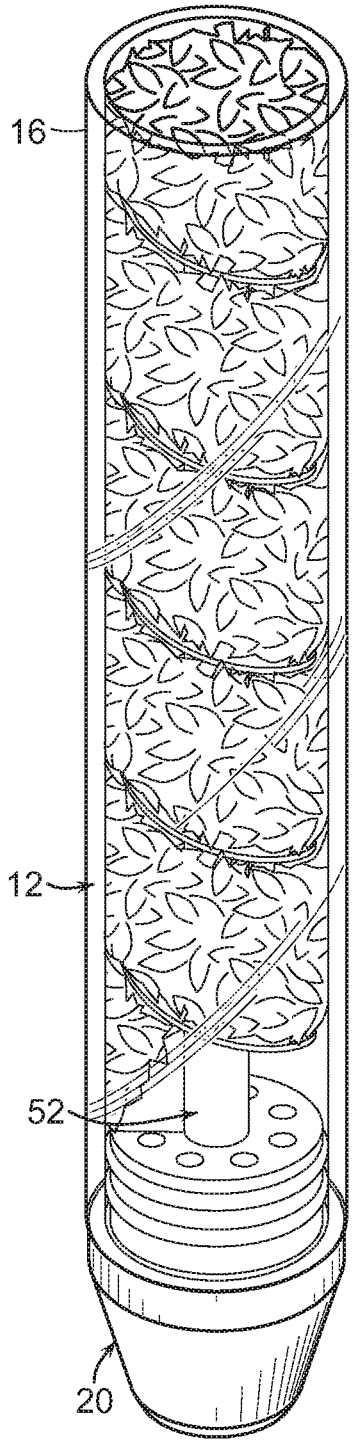
FIG. 7 is a perspective view of the smoking device filled with the smoking material and ready for use.

Referring to FIG. 7, where smoking device 10 is shown substantially filled with smoking material 8 with cap 60 removed.

Referring to FIG. 8, where smoking device 10 is shown after use and a number of clockwise rotations 68 of body 20. Clockwise rotation 68 of body 20 causes helical blade 60 of auger 52 to rotate and move smoking material 8 from lower open end portion 14 and inner portion 18 toward upper open end portion 16 and bowl area 100. Repeated clockwise rotation 68 of body 20 will cause substantially all of smoking material to be moved to bowl area 100 where it is ignited by a match, lighter, or other heat source. Glass housing 12 can be easily removed from body 20 to allow for filling of glass housing 12 by sliding lower open end portion 14 of glass housing 16 on and off first and second o-rings 48 and 50 that are mounted to rear body portion 26 of body 20.

The foregoing description is intended for purposes of illustration. The invention may be embodied in other forms or carried out in other ways without departing from the spirit or scope of the invention.

What is claimed:

1. A device for consuming a smoking material comprising:

a glass housing comprising a lower open end portion, an upper open end portion, and an inner portion; said glass housing being straight from said lower open end portion to said upper open end portion;

a body comprising a rear body portion rotatable relative to said lower open end portion of said glass housing; said rear body portion comprising a rear surface comprising a plurality of openings; and an auger comprising a first end portion directly engaged with said rear surface of said rear body portion and a second end portion; said auger being spaced apart and substantially surrounded by said plurality of openings; said auger extends within said glass housing from said rear surface to said upper end portion of said glass housing to form a bowl area within said upper open end portion of said glass housing; rotation of said body causes rotation of said auger causing the smoking material within said glass housing to move toward said bowl area.

2. The smoking device of claim 1, further comprising a first sealing member engaged with said rear body portion; said rear body portion of said body being rotatably and sealably engaged with said lower open end portion of said glass housing by said first sealing member.

3. The device of claim 2, wherein said rear body portion of said body is directly engaged with said lower open end portion of said glass housing by said first sealing member.

4. The device of claim 3, wherein said rear body portion of said body is removably engaged with said lower open end portion of said glass housing.

5. The device of claim 4, further comprising an air passage way extending inward from each of said plurality of openings in said rear surface of said rear body portion.

6. The device of claim 5, wherein said body further comprises a front body portion comprising a front surface; each of said air passage ways extend inward from said plurality of openings in said rear surface of said rear body portion to said front surface of said front body portion.

7. The device of claim 6, wherein said body further comprises an intermediate body portion disposed outside of said glass housing.

8. The device of claim 7, wherein said intermediate body portion of said body abuts said lower open end portion of said glass housing.

9. The device of claim 8, wherein said front body portion, said intermediate body portion and said rear body portion are integrally made from a single piece of material.

10. The device of claim 3, further comprising a second sealing member engaged with said rear body portion.

11. The device of claim 10, wherein each of said first and second sealing members is a rubber o-ring removably attached to said rear body portion.

12. The device of claim 2, wherein said lower open end portion of said glass housing is slidable on and off said first sealing member mounted to said rear body portion of said body to allow for filling of said glass housing with smoking material.

13. The device of claim 1, wherein said auger comprises a spiral flange extending from said first end portion of said auger to said second end portion of said auger.

14. The device of claim 1, wherein said auger is made from brass.

15. The device of claim 1, wherein said glass housing is a cylindrical tube.

16. The device of claim 1, wherein said glass housing, said auger, and said bowl area share a central longitudinal axis.

17. The device of claim 1, wherein said said auger is completely surrounded by said plurality of openings.

* * * * *